US005168647A

United States Patent [19]

Castro

[11] Patent Number: 5,168,647

[45] Date of Patent: Dec. 8, 1992

[54] MAP DISPLAY AND HOLDER DEVICE

[76] Inventor: Jose L. Castro, 235 S.W. LeJeune Rd., Miami, Fla. 33134

[21] Appl. No.: 708,131

[22] Filed: May 30, 1991

[51] Int. Cl.[5] ..... G09F 11/18

[52] U.S. Cl. ..... 40/518; 40/904; 160/85

[58] Field of Search ..... 40/117, 471, 518, 593, 40/904; 160/85, 86, 120, 122

[56] References Cited

U.S. PATENT DOCUMENTS

| | | | |
|---|---|---|---|
| 687,870 | 12/1901 | Watkinson | 160/85 |
| 1,614,957 | 1/1927 | Holloway et al. | 40/515 |
| 1,896,935 | 2/1933 | Bloomfield et al. | 40/518 |
| 2,281,022 | 4/1942 | Cavanaugh | 160/85 |
| 3,128,688 | 4/1964 | Coda | 40/518 X |
| 3,977,107 | 8/1976 | Warren | 40/518 |

FOREIGN PATENT DOCUMENTS

| | | | |
|---|---|---|---|
| 358090 | 9/1922 | Fed. Rep. of Germany | 40/518 |
| 1268866 | 9/1960 | France | 160/85 |

*Primary Examiner*—Joseph Falk
*Assistant Examiner*—Brian K. Green
*Attorney, Agent, or Firm*—J. Sanchelima

[57] ABSTRACT

A device for displaying and storing a flexible web containing information wound in two cylinder members that provide sufficient slag in the web to form a loop that holds a third cylinder member. The third cylinder member is pulled away from the first two either by gravity or spring action and the web is exposed by turning at least one of the first two cylinder members. The two cylinder members can be manually or electrically actuated. A user thereby views a specific area of the map or information contained in the web. An electric bulb is provided to illuminate the web from inside the loop created by the web.

15 Claims, 3 Drawing Sheets

MAP DISPLAY AND HOLDER DEVICE

BACKGROUND OF THE INVENTION

1. Field of the Invention

The present invention relates to devices for holding and storing maps and other information that can be affixed or printed to a flexible web made out of paper, plastic, cloth and the like.

When a user unfolds a map, he or she generally struggles to locate the area of interest after displaying a considerably large unmanageable portion of the map. Not infrequently this is done while sitting inside a vehicle with limited light and space frequently while moving. This causes considerable obstruction of the sight and also increases the probability of damaging the map being examined. All this also causes a user to waste time.

SUMMARY OF THE INVENTION

It is one of the main objects of the present invention to provide a device for displaying and storing maps and other information that can be affixed or printed to a web of a flexible material capable of being rolled.

It is another object of this present invention to provide a volumetrically efficient apparatus for storing and displaying a map or other information affixed to a flexible web.

It is also another object of this invention to provide such a device that is electrically illuminated.

It is yet another object of this present invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 2:
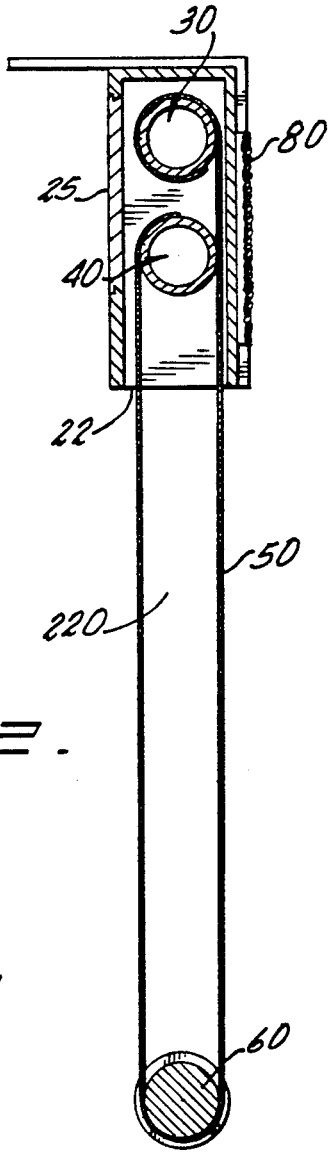
FIG. 2 shows an end view of the device shown in FIG. 1 wherein the end wall of the housing has been removed so that the internal cylinders can be seen.

Referring now to the drawings, where the present invention is generally referred to with numeral 10, it can be observed that it basically includes a housing 20 wherein two internally disposed cylinder members 30 and 40 contain flexible web 50 that in turn contains the information to be displayed, such as a map or instructions, etc. Web 50 is pulled down by the weight of outer cylinder member 60 acting on a loop created by web 50 in one of the preferred embodiments. Separation 220 of the web 50 is determined by the diameter of outer cylinder member 60, as best seen in FIG. 2. Also, it is possible to spring bias outer cylinder member 60 with spring member 150 so that reliance on the gravitational force is not necessary. Hanger or brace member 70 is preferably removably mounted to housing 20 and is capable of being mounted to any fixed place for the convenience of the user. The mechanism for mounting device 10 can be implemented in many different ways including screws, glue, Velcro pads etc. Cover 25 is removably mounted to housing 20, in the preferred embodiment, to permit access to cylinder members 30 and 40.

Figures 3, 4, 4A, 4B:
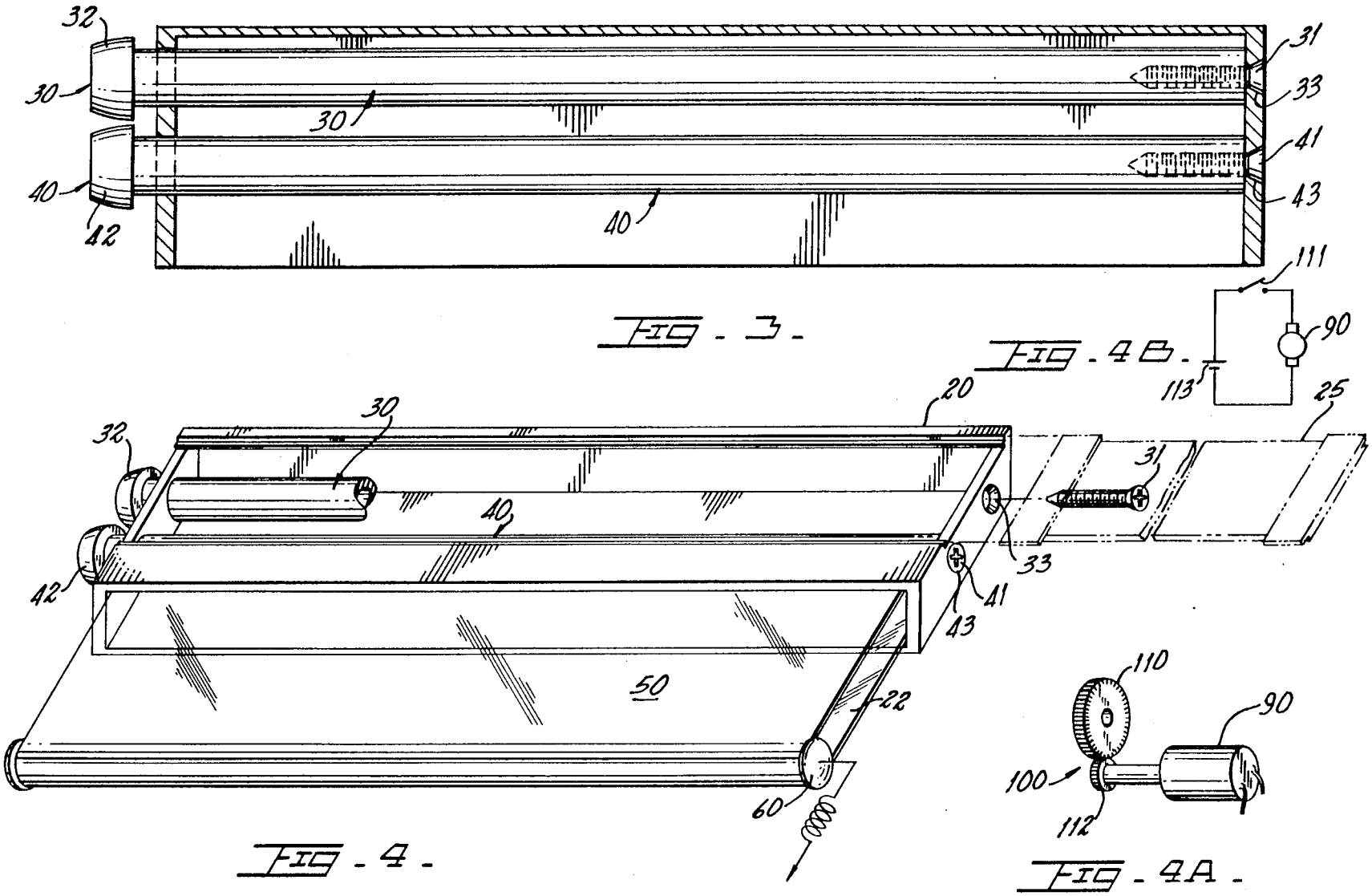
FIG. 3 illustrates a back view of the device represented in the previous figures wherein the back wall of the housing has been removed in order to expose the internal components.
FIG. 4 is a representation of an isometric view of the device shown in the previous figures wherein the housing is partially broken and the internal components are shown.
FIG. 4*a* illustrates an alternate method of driving the cylinder through an electric motor to expose the web with information that it contains.
FIG. 4*b* represents the electric circuit that drives one of the electric motors.

In operation, a user turns either cylinder member 30 or 40 to put out or take in web 50 so that the specific area of interest is the one that comes out first. In this manner, frequent consultations or look up operations for this specific area of interest do not require the entanglement of unwinding the entire web 50. Nevertheless, a user may unwind the entire map, if necessary and the space permits. In FIG. 3 and 4, flat head screws 31 and 41 are rigidly mounted to the ends of cylinders 30 and 40 that do not have the knobs. Screws 31 and 41 cooperatively fit in counter-sunk openings 33 and 43 and rotate therein.

Figure 2A:
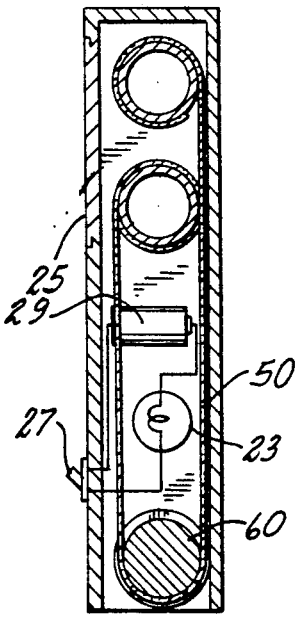
FIG. 2*a* shows a similar view to the one shown in FIG. 2 wherein a light bulb circuit has been included.
Figure 2B:
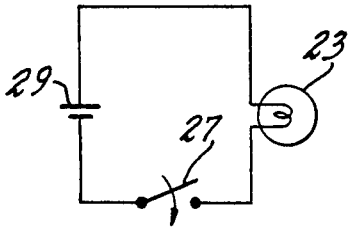
FIG. 2*b* represents the electrical shcematic of the light bulb circuit including a battery and a switch, as shown in FIG. 2*a*.

In FIG. 2*a*, an alternate embodiment showing an electric light bulb circuit is represented including light bulb battery 25 and switch 27. Light bulb 23 is positioned inside web 50 so that the latter is illuminated from the inside out. This is specially effective when web 50 is made out of a translucent material. Battery member 29 powers light bulb 23.

Figure 6:
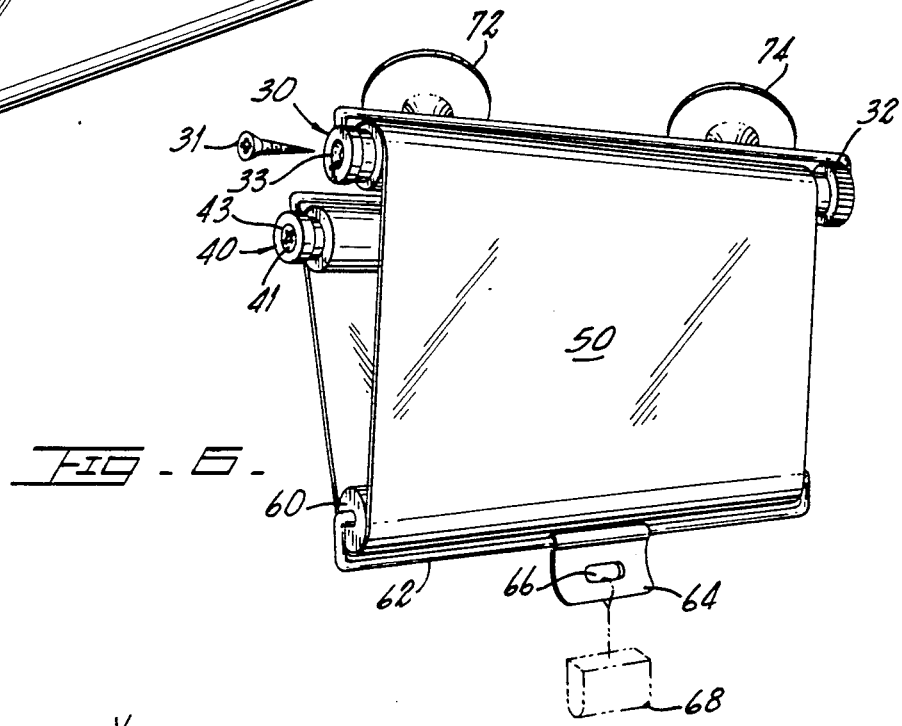
FIG. 6 illustrates a second alternate embodiment that does not utilize a housing.

Another manner of implementing a mounting mechanism is shown through the use of Velcro pads 80 affixed to the outer walls of housing 20. However, it may not be necessary to mount device 10 anywhere since it is portable enough to be placed in a user's pocket or purse. Also, brace member 70 can be supported by suction cups 72 and 74, as shown in FIG. 6.

Figure 1:
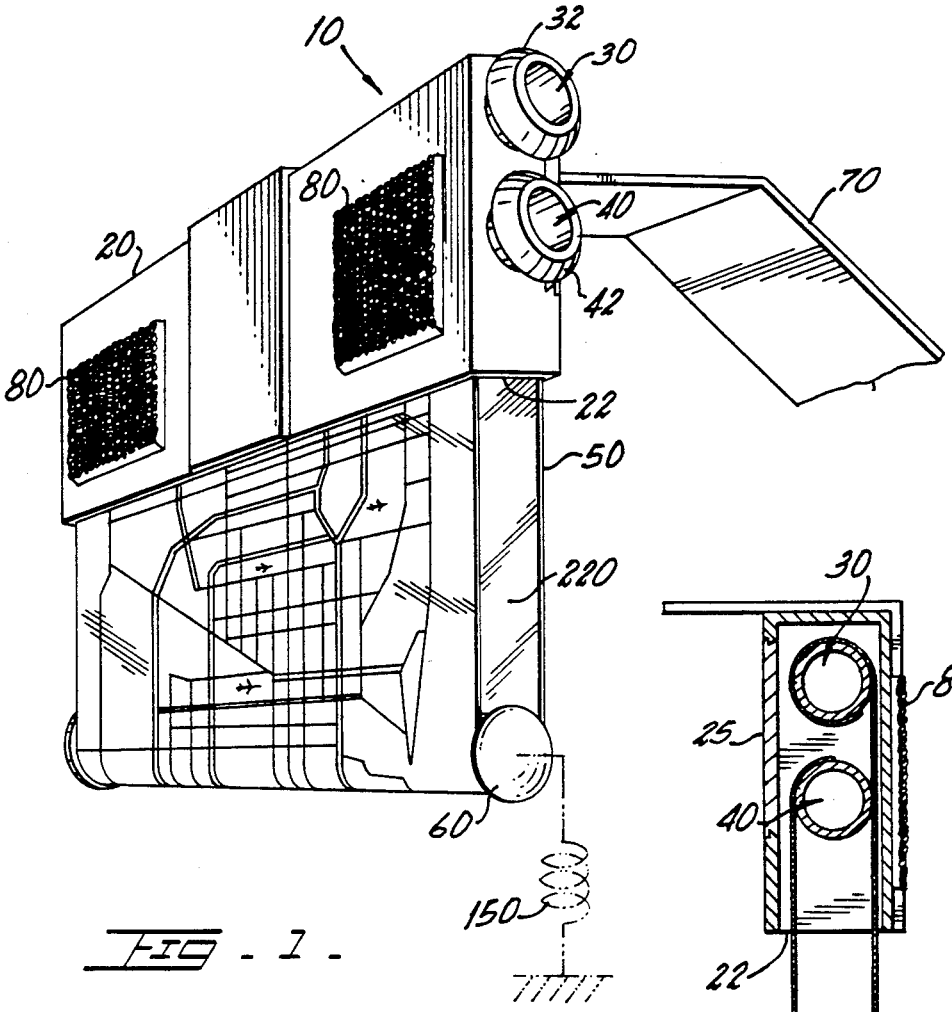
FIG. 1 represents an isometrical view of an embodiment for the present invention showing a portion of the web containing the information sought to be displayed protruding downwardly.

Preferably, internal cylinder members 30 and 40 are manually driven through knobs 32 and 42, as shown in FIGS. 1; 3 and 4. But, it is also possible to drive them through electrical motor 90 including, for instance, pinion gear assembly 100 properly meshed with a teethed knob 110 as shown in FIG. 4*a*. This electrical application will permit the faster and more accurate access of the required information since these motors can be servo mechanisms or step motors that are computer driven for a specific number of turns that correspond to a given location of the information in the web.

Housing 20 is shown in FIG. 1 showing an opening 22 through which web 50 falls outwardly by gravity or by a spring member 150. Spring member 150 can be mounted to a fixed position to exert a suitable force on outer cylinder member 60. Preferably, cylinder member 60 is held in a loop formed by web 50 that slides on the surface of cylinder member 60 and/or cylinder member 60 is rotably mounted by thereby permitting the easy exposure of web 50.

Figure 5:
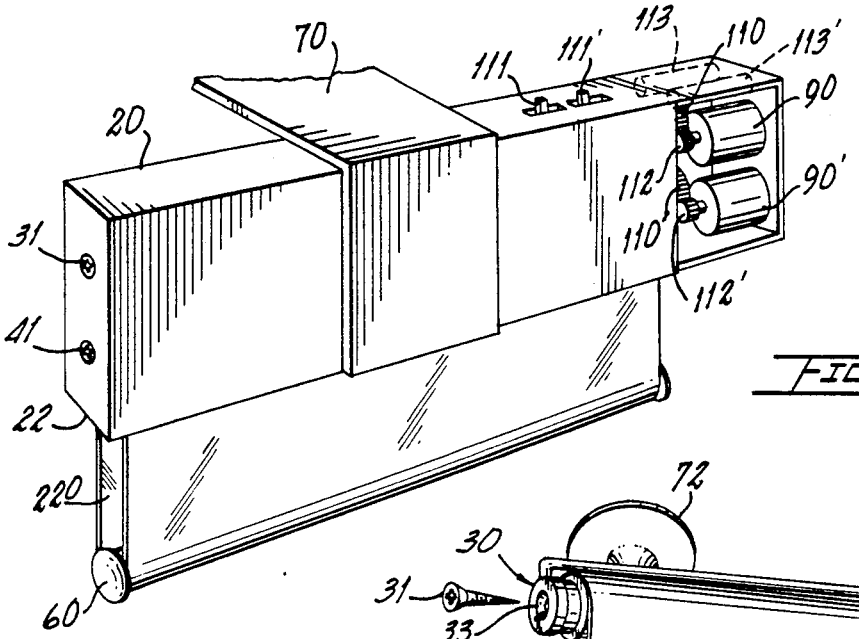
FIG. 5 shows an alternate embodiment that includes two electrically driven motors for actuating the cylinders.

As shown in FIG. 5, cylinder members 30 and 40 can be driven through electric motors 90 and 90' which are meshed with toothed knobs 110 and 110' through pinion gears 112 and 112'. Again, the rotation of motors 90 and 90' can be controlled through the use of switches 111 and 111'. Battery members 113 and 113' power electric motors 90 and 90', respectively.

In FIG. 6, another alternate embodiment is shown without requiring the use of a housing 20. Also, FIG. 6 shows that it is not necessary for cylinder members 30 and 40 to be in the same plane with outer cylinder 60.

Figure 7:
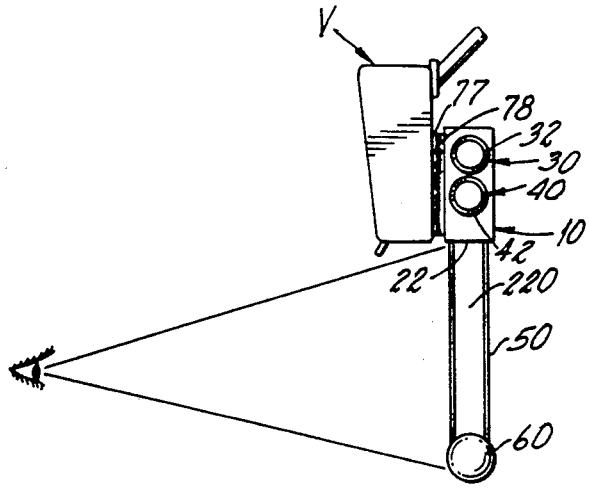
FIG. 7 shows one possible installation for the device represented in FIG. 1.
Figure 8:
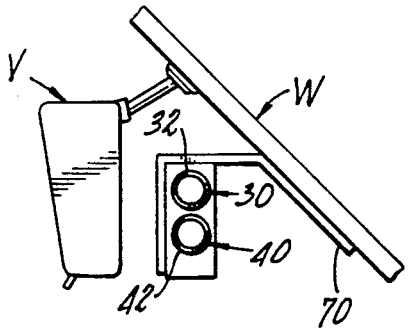
FIG. 8 represents another possible installation for the device shown in FIG. 1.

FIGS. 7 and 8 show two different areas in a vehicle where the present invention can be mounted. In FIG. 7, cooperating Velcro pads 77 and 78 are used as removable means for attaching device 10 to the rear surface of visor V. In FIG. 8, holder 70 is shown preferably glued against the inner surface of windshield W, but it can also be fixed with Velcro pads, suction cups or other means.

It is understood also that the present invention can be practiced even without a housing 20 or with housing of different shapes and dimensions to accommodate different maps or webs containing information.

It is believed the foregoing description conveys the best understanding of the objects and advantages of the present invention. Different embodiments may be made of the inventive concept of this invention. It is to be understood that all matter disclosed herein is to be interpreted merely as illustrative, and not in a limiting sense.

What is claimed is:

1. An apparatus including a flexible web having two ends for displaying and storing information, comprising:

A. first cylinder means for holding said web wound thereon from one of its ends;

B. second cylinder means for holding said web wound thereon from the other end;

C. third cylinder means suspended by said web and so arranged and constructed that said web forms a loop that cooperatively receives said third cylinder means and said third cylinder means urges said loop downwardly when at least one of said first and second cylinder means is unwound, said first, second and third cylinder means include axes that are positioned parallel with respect to each other and said axes being defined within a single plane; and D. a housing covering said first and second cylinder means said first and second cylinder means are rotatably supported on said housing and wherein said housing includes an opening for allowing said third cylinder means to pass through said opening.

2. The apparatus set forth in claim 1 wherein each of said first and second cylinder means include means for turning said first and second cylinder means.

3. The apparatus set forth in claim 2 wherein said means for turning said first and second cylinder means includes a knob member that protrudes outwardly from said housing.

4. The apparatus set forth in claim 3 wherein said means for turning said first and second cylinder means includes electric motor means for rotating said first and second cylinder means.

5. The apparatus set forth in claim 4 further including means for holding said apparatus to a fixed structure.

6. The apparatus set forth in claim 5 wherein said means for holding said apparatus includes Velcro pads.

7. The apparatus set forth in claim 5 wherein said means for holding said apparatus includes suction cup members.

8. The apparatus set forth in claim 1 further including spring means for pulling said third cylinder means away from said first and second cylinder means.

9. The apparatus set forth in claim 8 wherein each of said first and second cylinder means include means for turning said first and second cylinder means.

10. The apparatus set forth in claim 9 wherein said means for turning said first and second cylinder means includes a knob member that protrudes outwardly from said housing.

11. The apparatus set forth in claim 10 wherein said means for turning said first and second cylinder means includes first and second electric motor means for rotating said first and second cylinder means, respectively.

12. The apparatus set forth in claim 11 further including battery means connected to said first and second electric motor means and switch means for interrupting the connection of said battery means to said electric motor means.

13. The apparatus set forth in claim 1 wherein said web runs down substantially parallel to the plane defined by the axes of said first and second cylinder means towards said third cylinder means and further including:

E. means for illuminating said web positioned inside said loop.

14. The apparatus set forth in claim 13 wherein said means for illuminating said web includes a light bulb member and battery means connected thereto and further including switch means for interrupting the connection of said battery means to said light bulb member.

15. The apparatus set forth in claim 14 wherein said web is made out of a translucent material.

* * * * *